US009647330B1

(12) United States Patent
DiChiara

(10) Patent No.: US 9,647,330 B1
(45) Date of Patent: May 9, 2017

(54) WHISKER REINFORCED HIGH FRACTURE TOUGHNESS CERAMIC TIPS FOR RADOMES

(71) Applicant: The Boeing Company, Chicago, IL (US)

(72) Inventor: Robert A. DiChiara, Carlsbad, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 14/918,872

(22) Filed: Oct. 21, 2015

(51) Int. Cl.
*H01Q 1/42* (2006.01)
*H01Q 1/28* (2006.01)

(52) U.S. Cl.
CPC ..... *H01Q 1/42* (2013.01); *H01Q 1/281* (2013.01)

(58) Field of Classification Search
None
See application file for complete search history.

(56) References Cited

U.S. PATENT DOCUMENTS 8,765,230 B1 7/2014 Waldrop et al.
2007/0228211 A1* 10/2007 Facciano ..... F42B 10/46 244/3.19
2011/0050516 A1* 3/2011 Glabe ..... H01Q 1/42 343/705

FOREIGN PATENT DOCUMENTS

EP 0334577 9/1989
WO WO2010117474 10/2010

OTHER PUBLICATIONS

European Search Report issued Feb. 17, 2017 in co-pending European Patent Application No. 16194106.7.

* cited by examiner

*Primary Examiner* — Robert Karacsony
(74) *Attorney, Agent, or Firm* — Joseph M. Rolnicki; Evans & Dixon, L.L.C.

(57) ABSTRACT

A radome tip assembly has high fracture toughness due to a tip and a bushing fastener that attaches the tip to a radome where both the tip and bushing fastener are constructed from a mixture of aluminum oxide ceramic material and reinforcing silicon-carbide crystal whiskers and the radome is constructed of an oxide ceramic matrix composite material.

24 Claims, 5 Drawing Sheets

WHISKER REINFORCED HIGH FRACTURE TOUGHNESS CERAMIC TIPS FOR RADOMES

FIELD

This disclosure pertains to the construction of a nose cone assembly or a radome tip assembly of an aircraft, rocket, missile, etc. that houses a radar system or other similar communication system.

BACKGROUND

The nose cone of an aircraft, rocket, missile, etc. typically includes a radome that houses a radar system or other similar communication system of the aircraft, rocket, missile, etc. During operation of the aircraft, rocket, missile, etc., the radome is subjected to high speed that produces a high temperature in the material of the radome. This is particularly true in radomes on the tips of rockets and missiles.

High temperature advanced rocket and missile radomes are usually made out of monolithic ceramic materials. Examples of these monolithic ceramic materials include glass ceramic (Pyroceram® by Corning Incorporated), silicon nitride (Ceralloy® by Ceradyne, Inc.), and fused silica. These materials have a low dielectric constant for good electrical transmission. The radomes are typically constructed with a truncated cone configuration with an apex opening at the top of the cone configuration and a base opening at the bottom of the cone configuration. The radome has an interior volume that houses a radar system.

A tip of the radome is typically constructed separate from the radome. One reason for this is that the ceramic material of the radome shrinks during construction of the radome. The radome needs to have an exact cross-sectional dimension for good electrical transmission and predictions of the radar system, as well as a smooth exterior surface for aerodynamics. This requires that the radome be centered, and the exterior surface of the radome be machined and polished on a lathe. Forming the radome with an integral tip makes these manufacturing steps impractical. Additionally, forming the radome of a monolithic ceramic material with an integral tip produces a radome with a brittle monolithic ceramic at the tip. If the tip gets hit by direct impact from an object in flight, even from rain, it could cause a catastrophic failure of the tip and the radome.

High speed ceramic radomes are typically constructed using a separate metal tip. The metal tip improves impact resistance and reduces the likelihood of the monolithic ceramic material of the radome catastrophically failing during use. However, using a metal tip on the monolithic ceramic material of the radome creates a number of problems. The metal tip blocks the transmission of signals from the radar system and reflects or scatters the signals of the radar system, producing a large blind spot that reduces the performance of the radar system.

Additionally, the coefficient of thermal expansion of the metal tip is higher than the coefficient of thermal expansion of the monolithic ceramic materials used to construct the radome. This makes it difficult to create a hermetic seal between the metal tip and the ceramic radome that is necessary to retain a controlled environment in the interior volume of the radome to protect the radar system components. Over time, the coefficient of thermal expansion difference between the metal tip and the brittle ceramic radome produces microcracks in the monolithic ceramic material of the radome causing the seal between the metal tip and the radome to leak and also causing the metal tip to separate from the ceramic radome.

The use of a separate monolithic ceramic tip attached to the monolithic ceramic radome is also problematic. The brittle nature of the monolithic ceramic tip which could cause catastrophic failure of the tip on impact with objects, even rain. It is also difficult to securely attach a separate monolithic ceramic tip to a brittle ceramic radome.

SUMMARY

The radome tip assembly of this disclosure is comprised of a radome, a separate tip attached to the radome, and a bushing fastener used to attach the tip to the radome. The tip has an external screw threaded surface and the bushing fastener has an internal screw threaded surface. The bushing fastener internal screw threaded surface is screwed on the tip external screw threaded surface when attaching the tip to the radome.

The radome is constructed of an oxide ceramic matrix composite material. The material has continuous fibers that eliminate the possibility of catastrophic failure of the radome. The radome has good electronic signal transmission properties and a low coefficient of thermal expansion. The radome has a configuration of a truncated cone. The truncated cone configuration of the radome is defined by an exterior surface of the radome that has a conical configuration. The radome has an interior surface opposite the exterior surface. The interior surface surrounds an interior volume of the radome. The length of the radome extends between an apex surface and a base surface at opposite ends of the length of the radome. An opening is provided in the apex surface of the radome that opens to the interior volume of the radome.

The tip is attached to the apex surface of the radome. The tip is constructed of a mixture of aluminum oxide ceramic material and silicon-carbide crystal whiskers. The tip has a proximal end surface with a cylindrical configuration and a distal end surface with a conical configuration. An external screw threaded surface is formed on the proximal end surface of the tip. The external screw threaded surface extends through the opening in the apex surface of the radome and into the interior volume of the radome.

The bushing fastener is also constructed of a mixture of aluminum oxide ceramic material and silicon-carbide crystal whiskers. The bushing fastener has an exterior surface having a truncated cone configuration that is complementary to the configuration of the interior surface of the radome. The bushing is formed with a screw threaded interior surface that is complementary to the screw threaded external surface of the tip. The bushing screw threaded interior surface is screwed onto the screw threaded exterior surface of the tip in attaching the tip to the radome.

A glass seal is provided between the exterior surface of the bushing fastener and the interior surface of the radome. The glass seal also extends between the bushing fastener and the tip.

The mixture of aluminum oxide ceramic material and silicon-carbide whisker crystal materials used in constructing the tip and the bushing fastener has a coefficient of thermal expansion (CTE) that closely matches the coefficient of thermal expansion of the oxide ceramic matrix composite used to construct the radome. This eliminates the coefficient of thermal expansion mismatch problems between a metal tip and the monolithic ceramic material radome. As an example tips and bushings made out of Greenleaf WG-300 with 30% whisker reinforced alumina has a CTE of $6.0\times10^{-6}$ and WG-150 with 18% whisker reinforcement has a CTE of $7.0\times10^{-6}$. These two tip and bushing materials has a close CTE match to the oxide CMC using Nextel-720 fiber reinforcement which has an in-plane CTE is 6.56 ppm/C or the oxide CMC with the Nextel-610 fiber has an in-plane CTE of $7.87\times10^{-6}$/C. The tip constructed of the mixture of aluminum oxide ceramic material and silicon-carbide crystal whiskers can take high impact without catastrophically failing. The tip also does not block or reflect the radar like a metal tip.

The features, functions, and advantages that have been discussed can be achieved independently in various embodiments or may be combined in yet other embodiments, further details of which can be seen with reference to the following description and drawings.

DESCRIPTION

Figure 2:
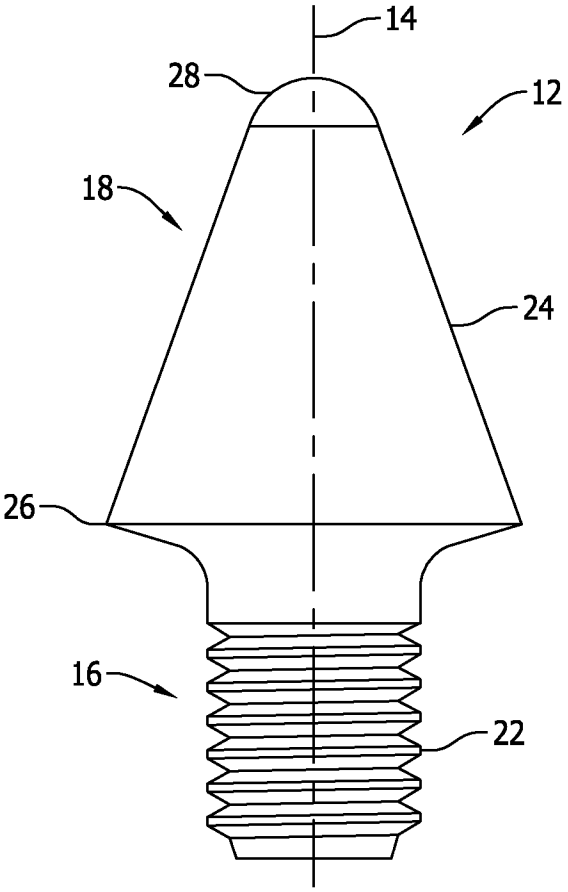
FIG. 2 is a representation of a side elevation view of the tip of this disclosure.
Figure 1:
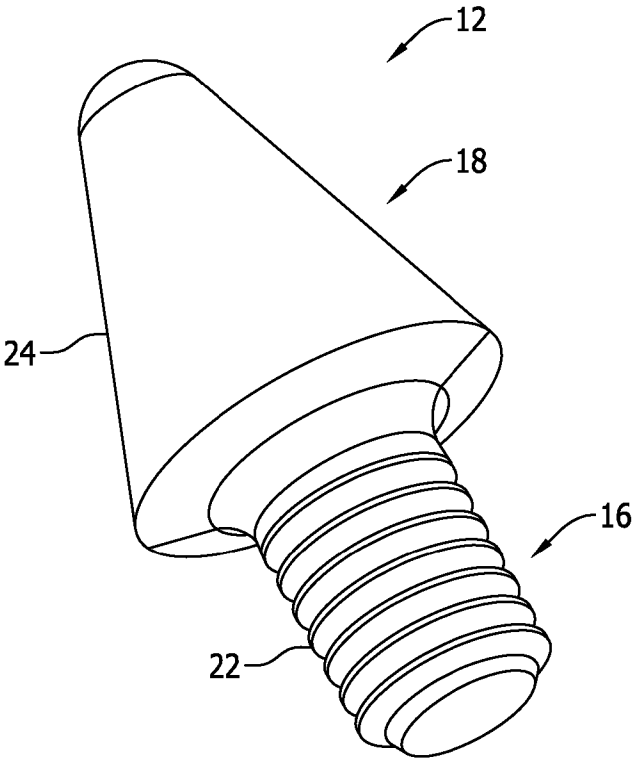
FIG. 1 is a representation of a perspective view of the tip of this disclosure.
Figure 4:
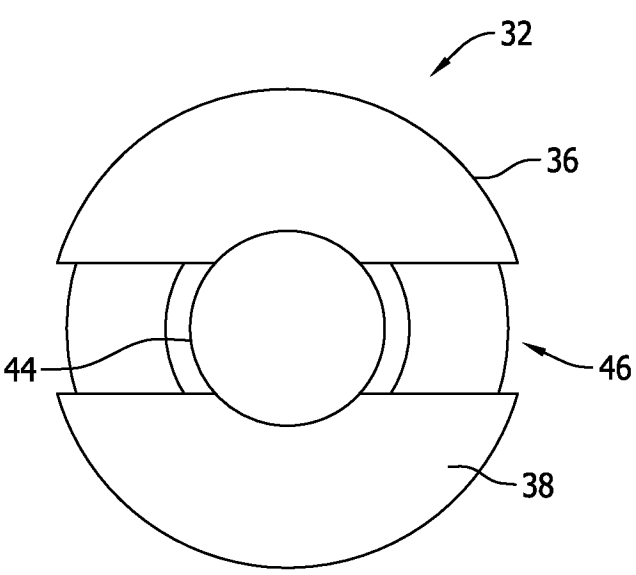
FIG. 4 is a representation of a plan view of a proximal end of the fastener bushing.
Figure 3:
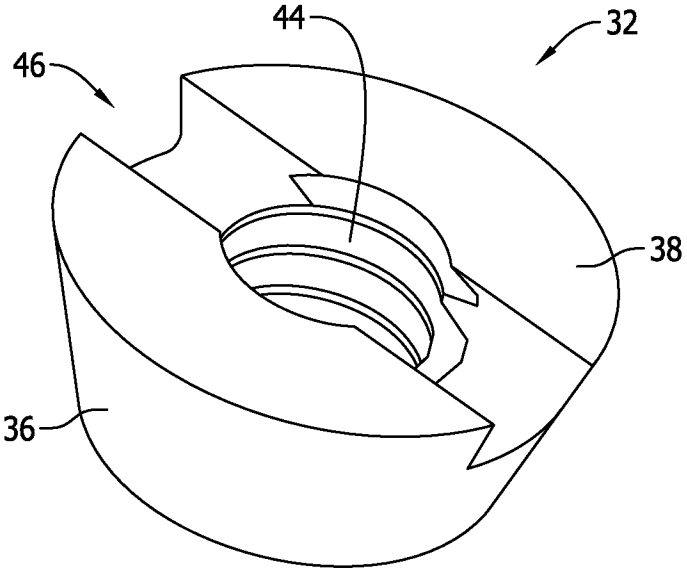
FIG. 3 is a representation of a perspective view of the fastener bushing of this disclosure.
Figure 6:
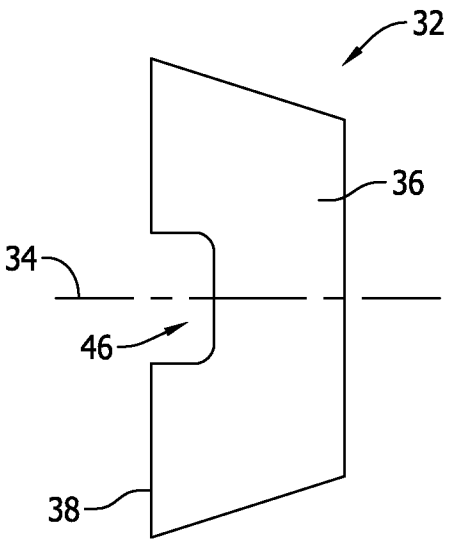
FIG. 6 is a representation of a side view of the fastener bushing.
Figure 5:
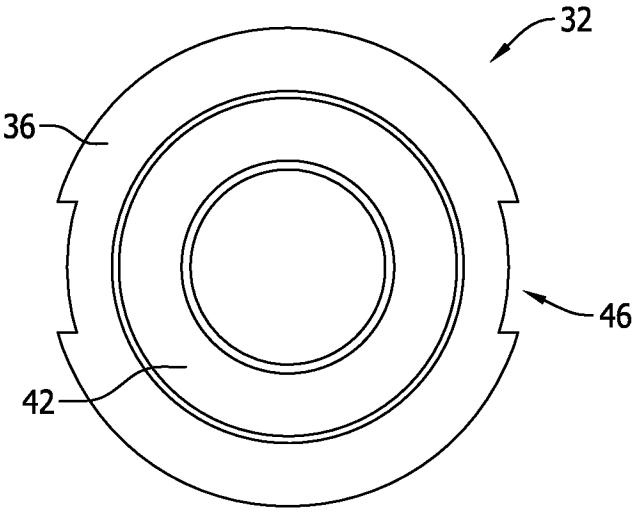
FIG. 5 is a representation of a plan view of a distal end of the fastener bushing.

FIG. 1 is a representation of a perspective view of the tip 12 of this disclosure. FIG. 2 is a representation of a side elevation view of the tip 12. The tip 12 has a center axis 14. The exterior surface configuration of the tip 12 is symmetric around the center axis 14. The tip exterior surface configuration includes a proximal surface portion 16 and a distal surface portion 18. The proximal surface portion 16 is defined by an external screw threaded surface 22. In the example of the tip 12 represented in FIGS. 1 and 2, the external screw threaded surface 22 is comprised of ⅜-16 threads. The distal portion 18 of the tip 12 is defined by an external conical surface 24. The conical surface 24 extends from a circular base edge 26 of the conical surface to a rounded apex surface 28. In the example of the tip 12 represented in FIGS. 1 and 2, the rounded apex surface 28 has a radius of curvature of 0.125 inches. The overall length of the tip 12 is 1 to 6 inches nominally about 1.40 inches. The length of the external screw threaded surface 22 is 0.25 to 2 inches nominally about 0.425 inches. Depending on the application of the tip 12, the dimensions of the tip could be different.

The tip 12 is constructed of a ceramic composite that uses the technology of whisker reinforcement. The hard ceramic matrix of the tip 12 is reinforced with extremely strong, stiff, silicon-carbide crystals, commonly called whiskers. The tip 12 is constructed of a ceramic matrix composite material that is a mixture of aluminum oxide ceramic material reinforced with silicon-carbide crystal whiskers. One example of a ceramic matrix composite material used to construct the tip 12 is the whisker reinforced ceramic material WG-300®, by Greenleaf Corporation. In WG-300®, the percentage of silicon-carbide crystal whiskers in the mixture of aluminum oxide ceramic material powder and the silicon-carbide crystal whiskers is approximately 30%. In other examples of the ceramic composite material used to construct the tip 12, the percentage of silicon-carbide crystal whiskers in the mixture of aluminum oxide ceramic material powder and the silicon-carbide crystal whiskers is in a range of 18%-30% of the mixture.

In the construction of the tip 12, a mixture of the aluminum oxide ceramic material powder and the silicon-carbide crystal whiskers is prepared. The mixture of the aluminum oxide ceramic material powder and the silicon-carbide crystal whiskers is put into a high temperature/high pressure press for forming a blank to be used in constructing the tip 12. The press has molds configured to form the tip 12 from the aluminum oxide ceramic material powder and the silicon-carbide crystal whiskers of the mixture. The mixture is positioned in the press between the molds and is hot pressed at a high temperature (over 3,000 degrees Fahrenheit) and compressed at a high pressure to form a blank of the tip 12. The blank of the tip 12 is formed with the tip proximal portion 16 being cylindrical and the tip distal portion 18 having the conical configuration. The blank is dense and has a fine grain size. The external pressure applied to the mixture in the press simultaneously with the temperature of the press produces good consolidation of the aluminum oxide ceramic material and the reinforcing silicon-carbide crystal whiskers.

The exterior screw threaded surface 22 is then machined on the cylindrical proximal portion 16 of the tip 12. The bottoms of the valleys of the screw threaded surface 22 are machined to be shallow to reduce the notch sensitivity of the screw threaded surface 22 under load. The whiskers in the blank help keep microcracks from forming and propagating through the tip proximal portion 16 during machining of the screw threaded surface 22.

FIGS. 3-6 show representations of the bushing fastener 32 of this disclosure. The bushing fastener 32 has a center axis 34. The exterior surface configuration of the bushing fastener 32 is basically symmetric around the center axis 34. The bushing fastener 32 is basically a conical nut. An exterior surface 36 of the bushing fastener 32 has a configuration of a truncated cone. The exterior surface 36 extends from a generally annular proximal end surface 38 to an annular distal end surface 42. An internal screw threaded surface 44 extends through the center of the bushing fastener 32 from the proximal end surface 38 to the distal end surface 42. A tool interfaced slot 46 extends across the center of the proximal end surface 38. In the example of the bushing fastener 32 represented in FIGS. 3-6, the bushing fastener has an axial length of 0.2 to 1.25 inches nominally about 0.30 inches. The diameter of the proximal end surface 38 is 0.5 to 2.0 inches nominally about 0.727 inches. The diameter of the distal end surface 42 is 0.25 to 1.75 inches nominally about 0.536 inches. The internal screw threaded surface 44 can be ¼-16 to ½-16 nominally ⅜-16 threads. Depending on the application of the bushing fastener 32, the dimensions of the bushing fastener 32 could be different.

The method of constructing the bushing fastener 32 is similar to that of the tip 12. In constructing the bushing fastener 32, the mixture of aluminum oxide ceramic material powder and the silicon-carbide crystal whiskers is prepared. The mixture of the aluminum oxide ceramic material powder and the silicon-carbide crystal whiskers is put into a high temperature/high pressure press for forming a blank to be used in constructing the bushing fastener 32. The press has molds that are configured for forming a blank for the bushing fastener 32. To form the internal screw threaded surface 44 of the bushing fastener 32, a graphite pre-form is machined with external screw threads that are complementary to the internal screw threaded surface 44 of the bushing fastener 32. The pre-form is positioned at the center of the mixture of aluminum oxide ceramic material powder and the silicon-carbide crystal whiskers prior to the press heating and compressing the mixture. During heating and compression of the mixture in the press into the dense, finished ceramic blank of the bushing fastener 32, the internal screw threaded surface 44 of the bushing fastener 32 is formed around the pre-form. After hot pressing of the mixture forming the bushing fastener blank is completed, the soft graphite pre-form having the external screw threaded surface is cleaned out of the bushing fastener blank, leaving a cost efficient, clean, precise internal screw threaded surface 44 in the bushing fastener 32. Because the internal screw threaded surface 44 is formed during the hot pressing of the aluminum oxide ceramic material powder and the silicon-carbide crystal whiskers in the press, no shrinkage of the internal screw threaded surface 44 occurs. This enables the production of a high tolerance internal screw threaded surface 44 that matches closely to the machined external screw threaded surface 22 of the tip 12.

As an alternative to using the mixture of aluminum oxide ceramic material powder and silicon-carbide crystal whiskers in construction the radome tip 12 and the bushing fastener 32, silicon nitride ($Si_3N_4$) could be used in their place. Since the silicon nitride material has low thermal expansion typically 3.0 to $3.5\times10^{-6}$/C compared to the WG-300 materials ($6.0\times10^{-6}$/C) or even higher metals it would be good with low CTE radome 52 materials like the typical monolithic ceramic materials include glass ceramic (Pyroceram® by Corning Incorporated), fused silica and the newer monolithic higher temperature radomes of silicon nitride (Ceralloy® by Ceradyne, Inc.).

Figure 7:
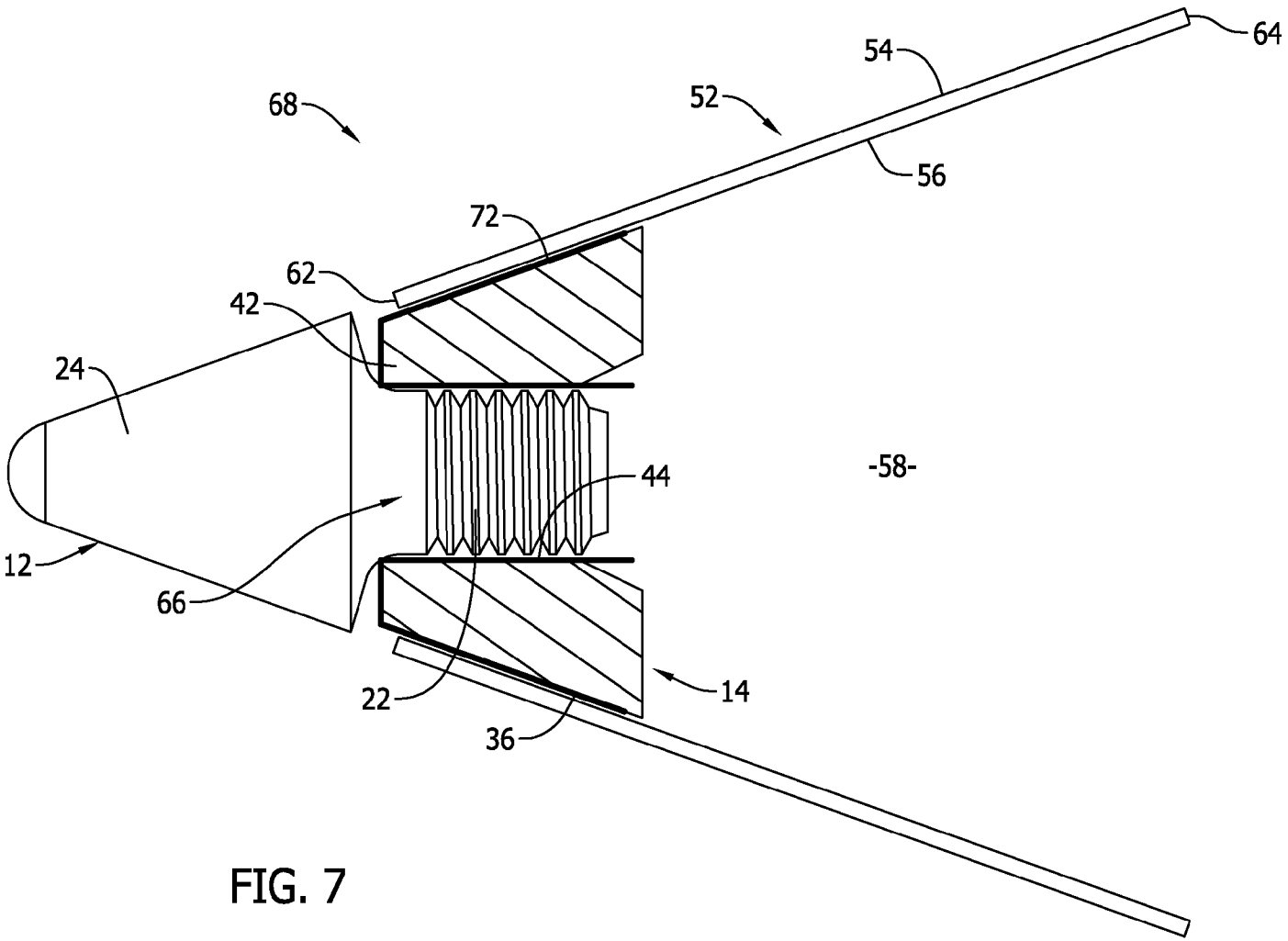
FIG. 7 is a representation of a cross-section side view of the tip and fastener bushing assembled to a radome.
Figure 8:
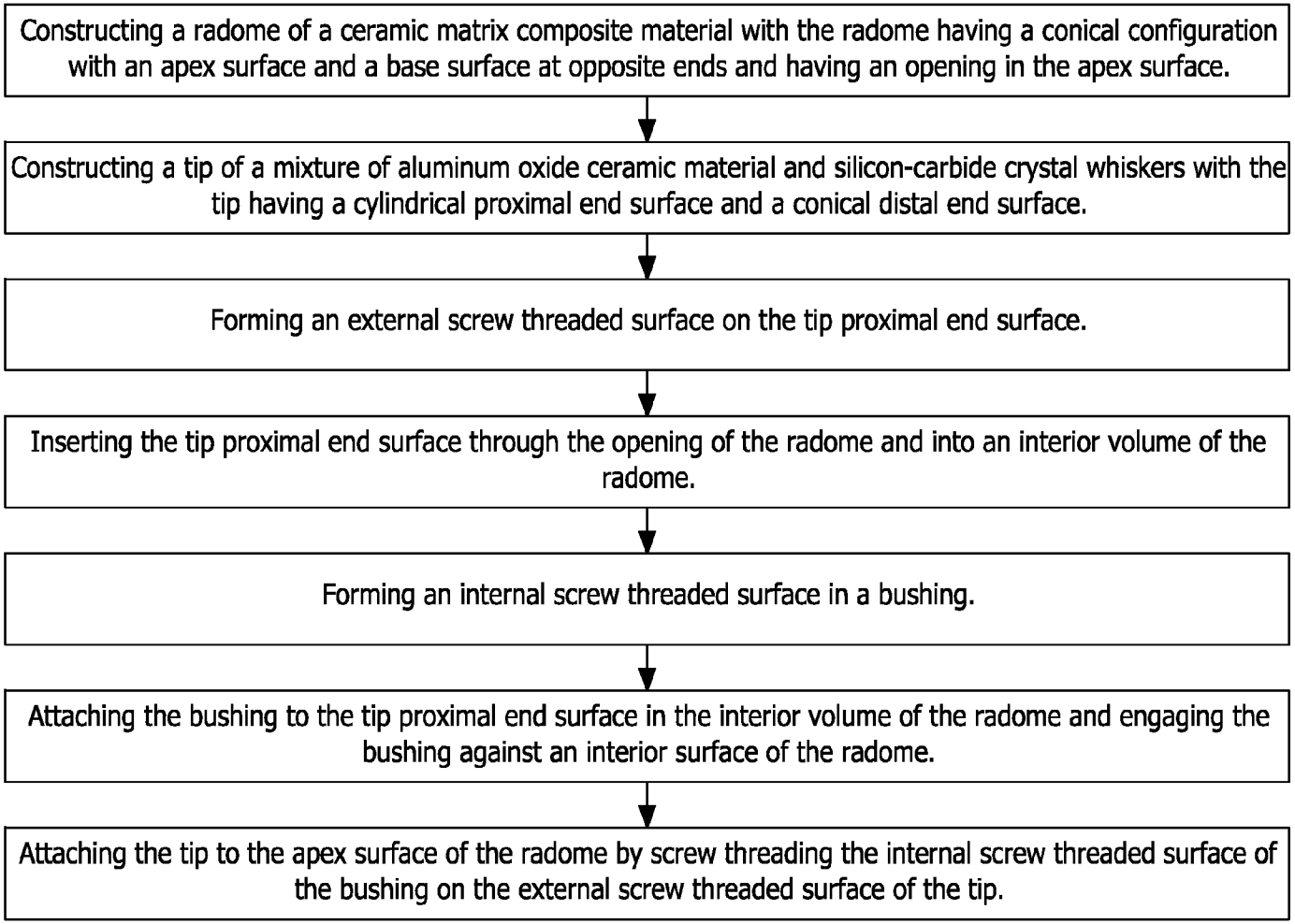
FIG. 8 is a flowchart representing the method of making the radome tip.

FIG. 7 is a representation of a cross-section view of a radome 52 with which the tip 12 and the bushing fastener 32 are used. The radome 52 has a configuration of a truncated cone. The truncated cone configuration of the radome 52 is defined by an exterior surface 54 of the radome that has a conical configuration. The radome 52 has an interior surface 56 opposite the exterior surface 54 that also has a conical configuration in the representation of the radome of FIG. 7. The interior surface 56 surrounds an interior volume 58 of the radome that contains the radar system. The exterior surface 54 and interior surface 56 extend from an apex surface 62 to a base surface 64 at opposite ends of the length of the radome 52. An opening 66 is provided in the apex surface 62 that opens to the interior volume 58 of the radome 52.

The radome 52 is constructed of an oxide ceramic matrix composite material. The material has continuous fibers that eliminate the possibility of catastrophic failure of the radome 52. The radome 52 has good electronic signal transmission properties and a low coefficient of thermal expansion due to the material used to construct the radome.

FIG. 7 represents a radome tip assembly 68 comprising the tip 12, the bushing fastener 32 and the radome 52. In FIG. 7, the proximal portion 16 of the tip 12 is inserted through the opening 66 in the apex surface 32 of the radome 52. Prior to the bushing fastener 32 being screw threaded on the external screw threaded surface 22 of the tip proximal portion 16, glass 72 is bonded to the internal screw threaded surface 44 of the bushing fastener 32 as well as the annular distal end surface 42 of the bushing fastener 32 and the exterior surface 36 of the bushing fastener 32. The bushing fastener 32 is then screw threaded onto the external screw threaded surface 22 of the tip 12. The bushing fastener 32 is continued to be screw threaded onto the external screw threaded surface 22 of the tip 12 until the tip distal portion 18 engages with the radome apex surface 62 and the exterior surface 36 of the bushing fastener engages with the interior surface 56 of the radome 52.

The radome tip assembly 68 is then heated, causing the tip 12 and the radome 52 to expand. The coefficient of thermal expansion of the tip 12 is slightly less than the coefficient of thermal expansion of the radome 52. This causes the tip 12 to become loose in the radome 52 due to the slight difference in the coefficients of thermal expansion. The heating causes the glass 72 to melt and fuse the bushing fastener 32 to the tip 12 and fuse both the bushing fastener 32 and tip 12 to the radome 52. On cooling of the radome tip assembly 68, the slightly higher coefficient of thermal expansion of the radome 52 will put the glass seal 72 in compression, making a good seal along the exterior surface 62 of the bushing fastener 32 and the interior surface 56 of the radome 52 as well as between the distal end surface 42 of the bushing fastener 32 and the distal portion 18 of the tip 12. The glass seal 72 also locks the external screw threaded surface 22 of the tip 12 to the internal screw threaded surface 44 of the bushing fastener 32. When the tip 12 is heated during flight, it will not loosen from the radome 52.

As various modifications could be made in the construction of the apparatus and its method of operation herein described and illustrated without departing from the scope of the invention, it is intended that all matter contained in the foregoing description or shown in the accompanying drawings shall be interpreted as illustrative rather than limiting. Thus, the breadth and scope of the present disclosure should not be limited by any of the above described exemplary embodiments, but should be defined only in accordance with the following claims appended hereto and their equivalents.

What is claimed:

1. A radome tip assembly comprising:

a radome, the radome having an exterior surface and an interior surface opposite the exterior surface, the radome having an interior volume surrounded by the interior surface and the radome, having an opening through the exterior surface to the interior volume;

a tip, the tip having a proximal end surface with a cylindrical configuration and a distal end surface with a conical configuration, the proximal end surface of the tip extending through the opening of the radome and into the interior volume of the radome;

a bushing on the proximal end surface of the tip in the interior volume of the radome, the bushing attaching the tip to the radome;

the proximal end surface of the tip is configured as an external screw threaded surface;

the bushing has an internal screw threaded surface through the bushing; and, the internal screw threaded surface of the bushing is screwed on the external screw threaded surface of the tip.

2. The radome tip assembly of claim 1, further comprising:

the bushing exerting a compression force on the interior surface of the radome and the bushing exerting a tension force on the proximal end surface of the tip.

3. The radome tip assembly of claim 1, further comprising:

the interior surface of the radome having a conical configuration; and, the bushing having an exterior surface with a conical configuration that is complementary to the interior surface of the radome conical configuration.

4. The radome tip assembly of claim 1, further comprising:

a glass seal between the bushing and the interior surface of the radome.

5. The radome tip assembly of claim 1, further comprising:

the radome has a length with a conical configuration, the length of the radome extends between an apex surface and a base surface at opposite ends of the length of the radome; and, the tip is attached to the apex surface of the radome.

6. The radome tip assembly of claim 5, further comprising:

the tip is constructed of a mixture of aluminum oxide ceramic material and silicon-carbide crystal whiskers.

7. The radome tip assembly of claim 5, further comprising:

the tip is constructed of silicon nitride.

8. The radome tip assembly of claim 6, further comprising:

the radome is constructed of a ceramic matrix composite material.

9. The radome tip assembly of claim 8, further comprising:

the bushing is constructed of a mixture of aluminum oxide ceramic material and silicon-carbide crystal whiskers.

10. The radome tip assembly of claim 8, further comprising:

the bushing is constructed of silicon nitride.

11. The radome tip assembly of claim 1, further comprising:

the tip being constructed of a ceramic material.

12. The radome tip assembly of claim 11, further comprising:

the ceramic material being a mixture of aluminum oxide ceramic material and silicon-carbide crystal whiskers.

13. The radome tip assembly of claim 11, further comprising:

the ceramic material being silicon-nitride.

14. The radome tip assembly of claim 12, further comprising:

the silicon-carbide crystal whiskers in the mixture being in a range of 18%-30% of the mixture.

15. The radome tip assembly of claim 12, further comprising:

the radome is constructed of a ceramic matrix composite material.

16. The radome tip assembly of claim 15, further comprising:

the ceramic matrix composite material is an oxide ceramic matrix composite material.

17. The radome tip assembly of claim 12, further comprising:

a glass seal between the tip and the radome.

18. The radome tip assembly of claim 12, further comprising:

a fastener on the tip, the fastener attaching the tip to the radome, the fastener being constructed of a mixture of aluminum oxide ceramic material and silicon-carbide crystal whiskers.

19. The radome tip assembly of claim 18, further comprising:

the fastener being constructed of a mixture of aluminum oxide ceramic material and silicon-carbide crystal whiskers with the silicon-carbide crystal whiskers in the mixture being in a range of 18%-30% of the mixture.

20. The radome tip assembly of claim 12, further comprising:

the tip has a first coefficient of thermal expansion;

the radome has a second coefficient of thermal expansion; and, the first coefficient of thermal expansion is less than the second coefficient of thermal expansion.

21. The radome tip assembly of claim 12, further comprising:

the radome has a length with a conical configuration, the length of the radome extends between an apex surface and a base surface at opposite ends of the length of the radome; and, the tip is attached to the apex surface of the radome.

22. A method of making a radome tip assembly comprising:

constructing a radome of a ceramix matrix composite material with the radome having a length with a conical configuration, the length of the radome extending between an apex surface of the radome and a base surface of the radome at opposite ends of the length of the radome;

constructing a tip of a ceramic material, the tip having a proximal end surface with a cylindrical configuration and a distal end surface with a conical configuration;

inserting the proximal end surface of the tip through the opening of the radome and into an interior volume of the radome;

attaching a bushing on the proximal end surface of the tip in the interior volume of the radome with the bushing engaging against the interior surface of the radome and the bushing attaching the tip to the apex surface of the radome;

forming an external screw threaded surface on the proximal end surface of the tip;

forming an internal screw threaded surface in the bushing; and, attaching the bushing to the proximal end surface of the tip and attaching the tip to the apex surface of the radome by screw threading the internal screw threaded surface of the bushing on the external screw threaded surface of the tip.

23. The method of claim 22, further comprising:

constructing, the tip of a mixture of aluminum oxide ceramic material and silicon-carbide crystal whiskers.

24. The method, of claim 22, further comprising:

attaching the bushing to the proximal end surface of the tip with the bushing engaging against an interior surface of the radome.

* * * * *